US007387273B1

(12) United States Patent
Wolfson et al.

(10) Patent No.: US 7,387,273 B1
(45) Date of Patent: Jun. 17, 2008

(54) PAPER ROLL DISPENSER WITH ROLL RETAINING TRAY

(75) Inventors: Marla Wolfson, 7 Rolling Dr., Brookville, NY (US) 11545; Edward Drew, Roselle Park, NY (US); Richard M. Franczak, Laurence Harbor, NJ (US)

(73) Assignee: Marla Wolfson, Glen Cove, NY (US)

( * ) Notice: Subject to any disclaimer, the term of this patent is extended or adjusted under 35 U.S.C. 154(b) by 0 days.

(21) Appl. No.: 11/724,021

(22) Filed: Mar. 14, 2007

(51) Int. Cl.
*B65H 67/00* (2006.01)

(52) U.S. Cl. ..... 242/560.3; 242/594.1; 242/594.6

(58) Field of Classification Search ..... 242/560, 242/560.2, 560.3, 561, 596, 596.8, 594, 594.1, 242/594.3, 594.4, 594.5, 594.6, 595; D6/518, D6/519, 520, 523
See application file for complete search history.

(56) References Cited

U.S. PATENT DOCUMENTS

| | | | | | |
|---|---|---|---|---|---|
| 1,686,911 | A | * | 10/1928 | Fredlund | 242/560.3 |
| 2,904,274 | A | * | 9/1959 | Hicks | 242/560.3 |
| D189,105 | S | * | 10/1960 | Costen | D6/520 |
| 2,959,368 | A | * | 11/1960 | Neff | 242/560.3 |
| 3,007,177 | A | * | 11/1961 | Jackson et al. | D6/519 |
| D249,309 | S | * | 9/1978 | Williams | D6/520 |
| 4,294,389 | A | * | 10/1981 | Falk et al. | 242/560.3 |
| D273,160 | S | * | 3/1984 | Moreland | D6/520 |
| D342,852 | S | * | 1/1994 | Welch | D6/520 |
| 5,868,335 | A | | 2/1999 | Lebrun | |
| 6,484,965 | B1 | | 11/2002 | Reaves | |
| D478,737 | S | * | 8/2003 | Sparkowski | D6/518 |
| D546,605 | S | * | 7/2007 | Wolfson | D6/520 |
| D547,984 | S | * | 8/2007 | Wolfson | D6/520 |

* cited by examiner

*Primary Examiner*—William A Rivera
(74) *Attorney, Agent, or Firm*—Robert L. Epstein; Epstein Drangel Bazerman & James, LLP

(57) ABSTRACT

The dispenser includes an enclosure for holding a plurality of paper rolls in stacked, substantially vertical relation. The front wall of the enclosure has an opening through which a paper roll may move to exit the enclosure. A tray is provided for retaining a paper roll as it moves through the exit opening. A section of the rear wall is inclined to guide a paper roll through the exit opening and into the retaining tray. A removable divider is provided to convert the dispenser for use with different size paper rolls. Brackets for rotatably mount a paper roll extend from the bottom of the enclosure for dispensing individual sheets. Removable decorative panels are provided for mounting proximate the front and side walls. The dispenser may be supported on a horizontal surface by the bottom, suspended from a vertical surface or hung from a door. Openings in the walls permit observation of the number of papers rolls remaining in the enclosure. In one embodiment, the front wall is provided with slots for removably mounting photographs.

23 Claims, 10 Drawing Sheets

16
42
C
12
18
9
B2
B2
B2
B2
B2
38
38
14
32
34
A
10
38
26
22
20
24
6
54
23
54
B1

C
7
32
42
18
A
42
12
38
38
10'
28
36
22
17
26
25
23
24
38
38
34

18
12
10
10
10
A
11
11
17
38
36
16
38
32

36
18
16
42
A
42
12
14
34
32
38
38
52
10'
28
17
26
25
24
22
23
38
38

PAPER ROLL DISPENSER WITH ROLL RETAINING TRAY

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to paper rolls, such as rolls of paper towels or toilet paper, and more particularly to a snap-together plastic dispenser for paper rolls that is suitable for use with different size rolls and which has a roll retaining tray, removable decorative panels, wall and door mounting means and observation openings.

2. Description of Prior Art Including Information Disclosed Under 37 CFR 1.97 and 1.98

Rolls of paper products, such as paper towels and toilet paper, are common household items. However, such rolls are bulky and difficult to store in an efficient manner. Further, there is no easy way to dispense the rolls, one at a time, as needed.

The present invention addresses those issues by providing an aesthetically pleasing dispenser for paper rolls which converts to neatly store paper rolls of different sizes in a vertical stack and employs a gravity feed by which the rolls are delivered, one by one, to a retaining tray for easy removal.

The dispenser is inexpensive to fabricate being formed of injection molded parts that snap-together for easy assembly. Easily removable decorative front and side panels enhance the appearance of the dispenser. The dispenser is versatile in that it can rest on a horizontal surface such as a tabletop, mount on a vertical surface, such as a wall, or hang from a door. Removable paper towel roll mounting brackets extend from the bottom of the dispenser for dispensing individual paper towels. Observation openings are provided to permit the user to track the number of rolls remaining in the dispenser. Further, the front wall of the dispenser may include a plurality of recesses for mounting photographs or the like.

BRIEF SUMMARY OF THE INVENTION

It is, therefore, a prime object of the present invention to provide a dispenser for paper rolls, such as paper towels rolls and toilet paper rolls.

It is another object of the present to provide a paper roll dispenser which is convertible to accommodate paper rolls of different sizes.

It is another object of the present to provide a paper roll dispenser with removable decorative front and side panels.

It is another object of the present to provide a paper roll dispenser with means for mounting the dispenser on a vertical surface and for hanging the dispenser on a door.

It is another object of the present to provide a paper roll dispenser with openings for observing the number of rolls remaining in the dispenser.

It is another object of the present to provide a paper roll dispenser that is formed of inexpensive plastic molded parts that snap-together for easy assembly.

It is another object of the present to provide a paper roll dispenser with a front panel having a plurality of recesses for mounting photographs or the like.

In general, the above objects are achieved by the dispenser of the present invention, as explained below.

In accordance with one aspect of the present invention, a paper roll dispenser is provided including an enclosure for holding a plurality of paper rolls in stacked, substantially vertical relation. The enclosure has an opening through which a paper roll may move to exit the enclosure. Means are provided for retaining a paper roll as the roll passes through the exit opening.

The dispenser also includes means for guiding a paper roll through the exit opening and into the roll retaining means. The enclosure has a rear wall. The guiding means is preferably formed of an inclined section of the rear wall.

The roll retaining means is a tray having a recess adapted to receive a paper roll. The recess is defined at least in part by an arcuate surface. The arcuate surface defines a section of a cylinder.

The dispenser also includes means for rotatably mounting a paper roll beneath the enclosure such that individual paper sheets can be dispensed.

Means are provided for converting the enclosure to hold paper rolls of different sizes. That means takes the form of means for dividing the enclosure into sections. The dividing means is removable.

The enclosure includes a wall. A decorative panel is adapted to be mounted over the enclosure wall.

The dispenser also includes means for mounting the enclosure on a vertical surface and means for hanging the enclosure on a door.

In accordance with another aspect of the present invention, a paper roll dispenser is provided including an enclosure for holding a plurality of paper rolls in stacked, substantially vertical relation. The enclosure has a wall. A removable decorative panel is adapted to be mounted adjacent the wall. Means are provided for removably mounting the panel adjacent the wall.

The mounting means includes first and second channels situated proximate the edges of the wall, respectively, so as to define a slot to receive the panel.

The wall has an arcuate surface.

The wall also has a slot adapted to receive a photograph.

In accordance with another aspect of the present invention, a paper roll dispenser is provided including an enclosure for holding a plurality of paper rolls in stacked, substantially vertical relation. The enclosure has a bottom and a rear wall. Means associated with the rear wall are provided for mounting the enclosure, such that the dispenser may be supported on a substantially horizontal surface by the bottom or be suspended from a substantially vertical surface by the mounting means.

The dispenser also includes means for hanging the enclosure from a door. The hanging means includes at least one bracket defining a recess adapted to receive the top of the door.

In accordance with another aspect of the present invention, a paper roll dispenser is provided including an enclosure for holding a plurality of paper rolls in stacked, substantially vertical relation. The enclosure has a wall. The wall has an opening for observing the number of papers rolls remaining in the enclosure.

In accordance with another aspect of the present invention, a paper roll dispenser is provided including an enclosure for holding a plurality of paper rolls in stacked, substantially vertical relation. The enclosure has first and second walls. Means are provided for attaching the first and second walls together in a snap-together fashion. The attaching means includes a recess on one of the first and second walls adapted to receive an edge of the other of the walls.

In accordance with another aspect of the present invention, a paper roll dispenser is provided including an enclosure for holding a plurality of paper rolls in stacked, substantially vertical relation. The enclosure has a bottom. Means are provided for rotatably mounting a paper roll beneath the enclosure bottom.

The paper roll mounting means includes first and second spaced mounting brackets.

BRIEF DESCRIPTION OF THE SEVERAL VIEWS OF DRAWINGS

To these and to such other objects that may hereinafter appears, the present invention relates to a paper roll dispenser with a roll retainer as described in detail in the following specification and recited in the annexed claims, taken together with the accompanying drawings, in which like numerals refer to like parts and in which:

DETAILED DESCRIPTION OF THE INVENTION

Figure 1:
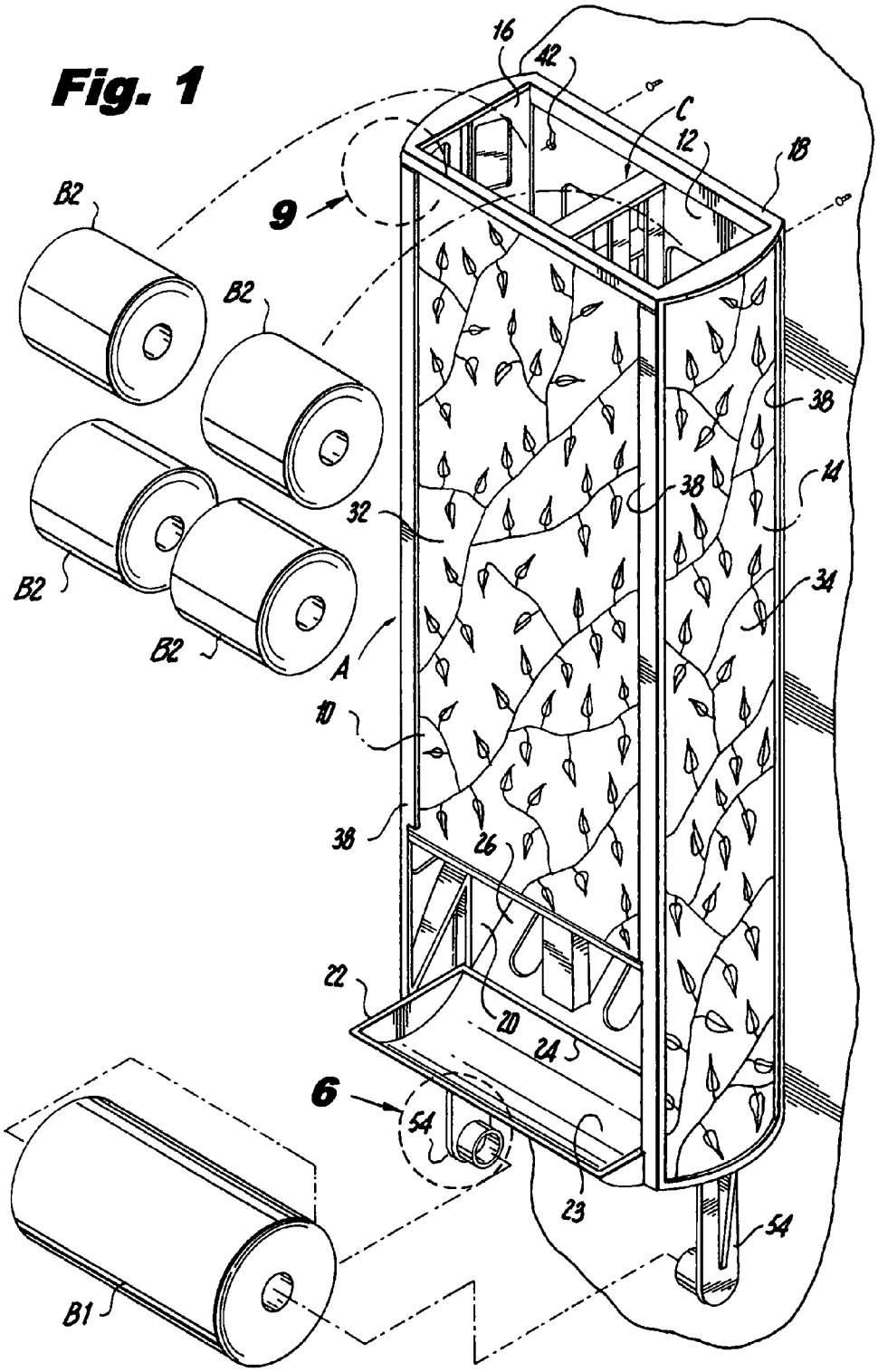
FIG. 1 is an isometric view of a preferred embodiment the paper dispenser of the present invention showing the top, front wall and one side wall thereof, with front and side decorative panels, a divider so that toilet paper rolls can be accommodated in the enclosure and the brackets for rotatably mounting a paper towel roll beneath the enclosure.

The present invention related to a dispenser, generally designated A, designed to hold and dispense a plurality of paper rolls, generally designated B. Rolls B can be of any size. However, rolls are shown in the figures as paper towel rolls, generally designated B1, or toilet paper rolls, generally designated B2, for purposes of illustration. As will become evident from the following description, dispenser A can be used to hold and dispense these different size rolls, through the use of a removable divider, generally designated C.

Dispenser A is formed of an enclosure, which includes a front wall 10, a rear wall 12, arcuate side walls 14, 16 and an open top 18, adapted to hold dispense a plurality of paper rolls B in stacked, substantially vertical relation. Each of the walls 10, 12, 14 and 16 are made of injection molded plastic and provided with a plurality of openings 17 to decrease the weight of the dispenser and to permit observation of the number of paper rolls remaining in the dispenser, such that the user knows when the dispenser needs to be refilled.

The enclosure has an exit opening 20 formed in the lower portion of front wall 10. Opening 20 is large enough to permit a paper towel roll B1, or pair of toilet paper rolls B2, to pass through, such that the roll or rolls at the bottom of the stack can exit the enclosure.

Figure 3:
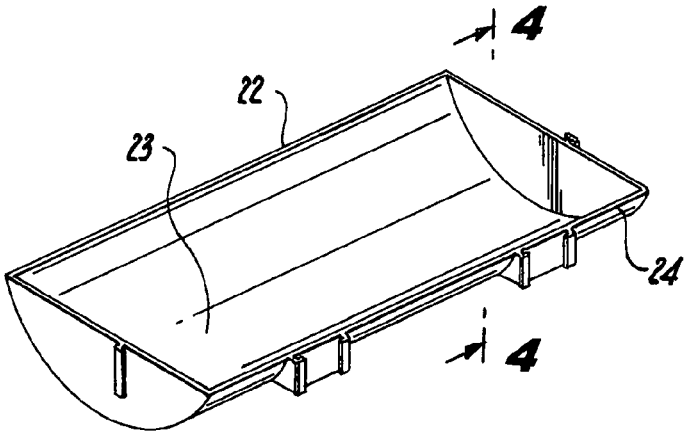
FIG. 3 is an isometric view of the roll retaining tray.
Figure 4:
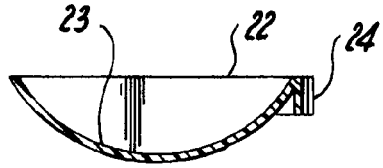
FIG. 4 is a cross-sectional view of the tray taken along line 4-4 of FIG. 3.
Figure 5:
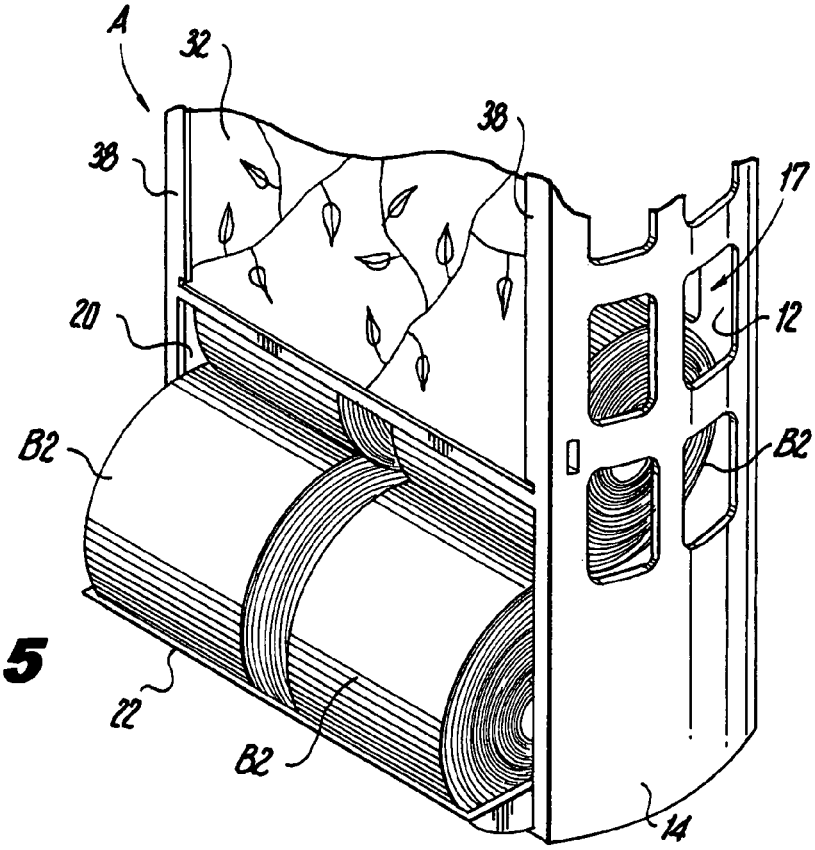
FIG. 5 is an isometric view of the lower portion of the enclosure showing toilet paper rolls situated in the tray.

Means are provided for retaining a paper towel roll B1, or pair of toilet paper rolls B2, as it or they move through the exit opening 20, so that same may be easily removed from the enclosure. Those means take the form of a paper roll retaining tray 22. Tray 22 preferably has an arcuate bottom surface 23 defining a recess having the shape of a section of a cylinder, as best seen in FIGS. 3 and 4. The tray will receive a paper roll B1, or pair of toilet paper rolls B2, as it or they passes through the exit opening 20 of the enclosure and retain same until it is or they are removed, allowing the next paper towel roll, or pair of toilet paper rolls, to move into the tray.

The rear edge 24 of paper roll retaining tray 22 is attached to the bottom edge 25 of an inwardly inclined lower section 26 of rear wall 12 of the enclosure by a pair of downwardly extending tabs that are received in recesses on extending from edge 24. Section 26 acts as a means for guiding a paper towel roll B1, or pair of toilet paper rolls B2, through exit opening 20 and into the retaining tray 22. The upper edge 28 of section 26 is connected to the lower edge of the non-inclined portion of rear wall 12.

Figure 2:
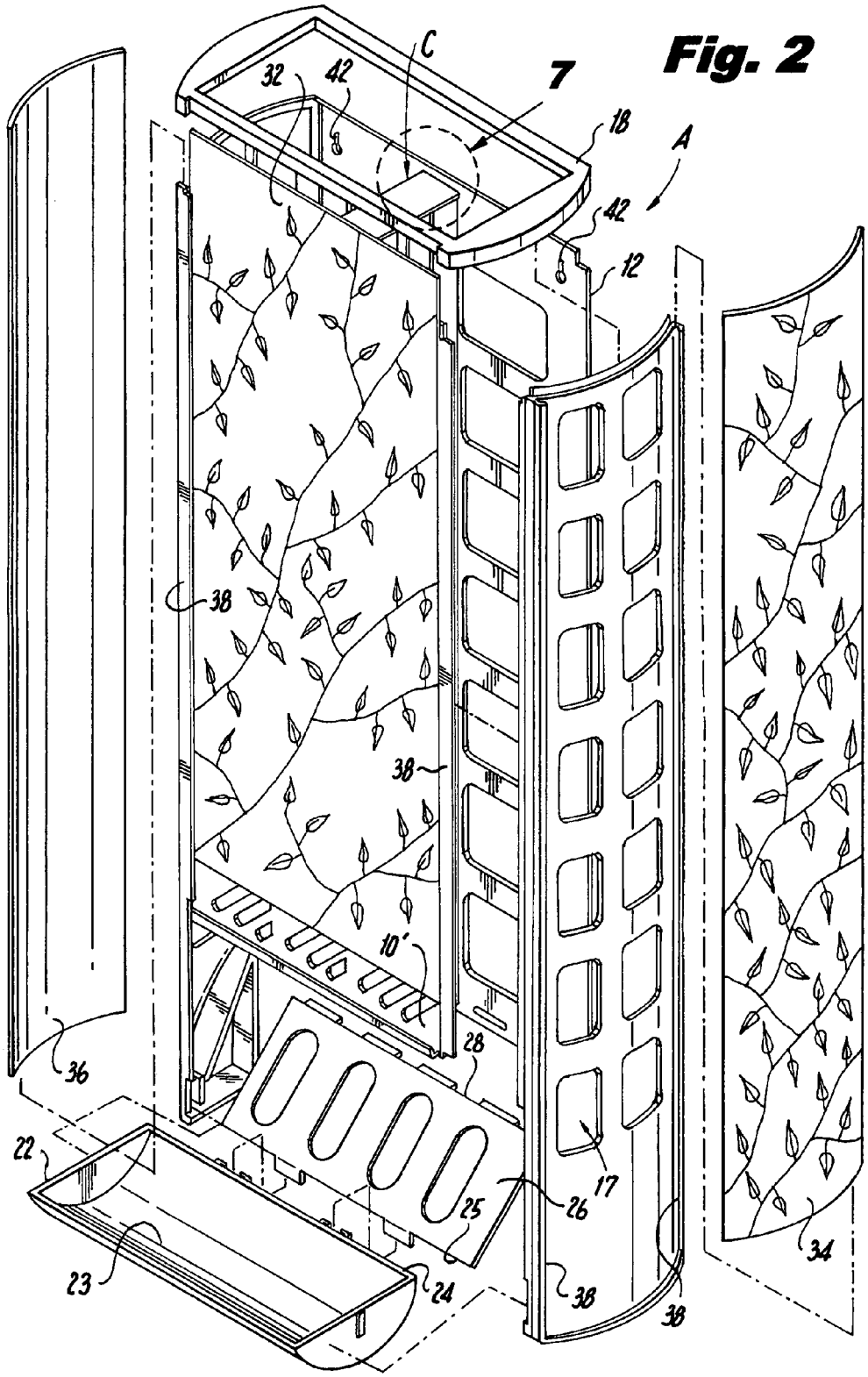
FIG. 2 is an exploded isometric view of a preferred embodiment of the paper dispenser of the present invention showing the top, front wall and one side wall thereof, with front and side decorative panels, the roll retaining tray and the inclined rear wall section for guiding rolls into the tray.
Figure 8:
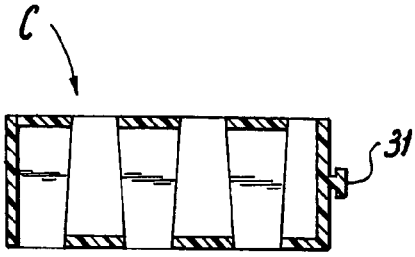
FIG. 8 is a cross-sectional view of the divider taken along line 8-8 of FIG. 7.
Figure 7:
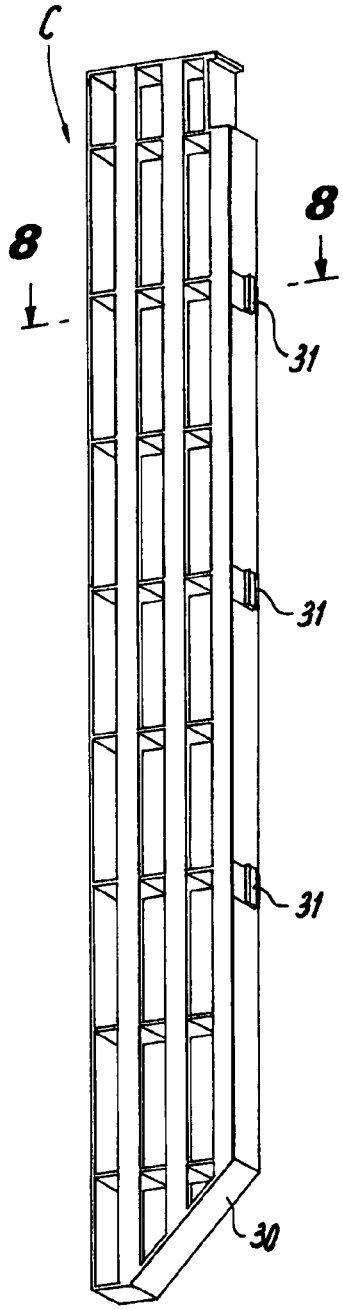
FIG. 7 is an exploded isometric view of the enclosure divider.
Figure 12:
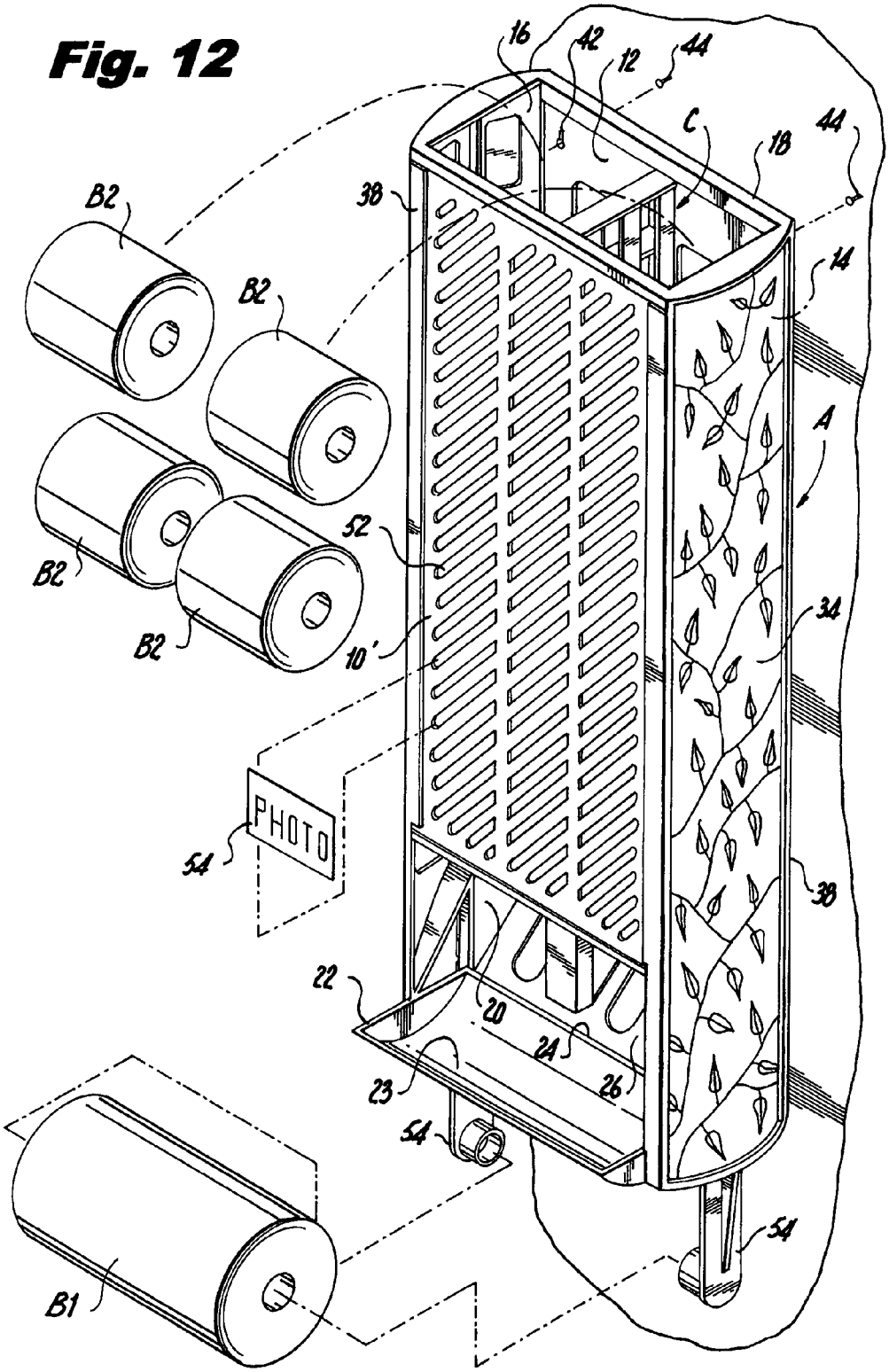
FIG. 12 is a view of the preferred embodiment of the paper dispenser of the present invention similar to FIG. 1 but with the front decorative panel removed, showing the photo mounting slots on an alternate version of the front wall.
Figure 13:
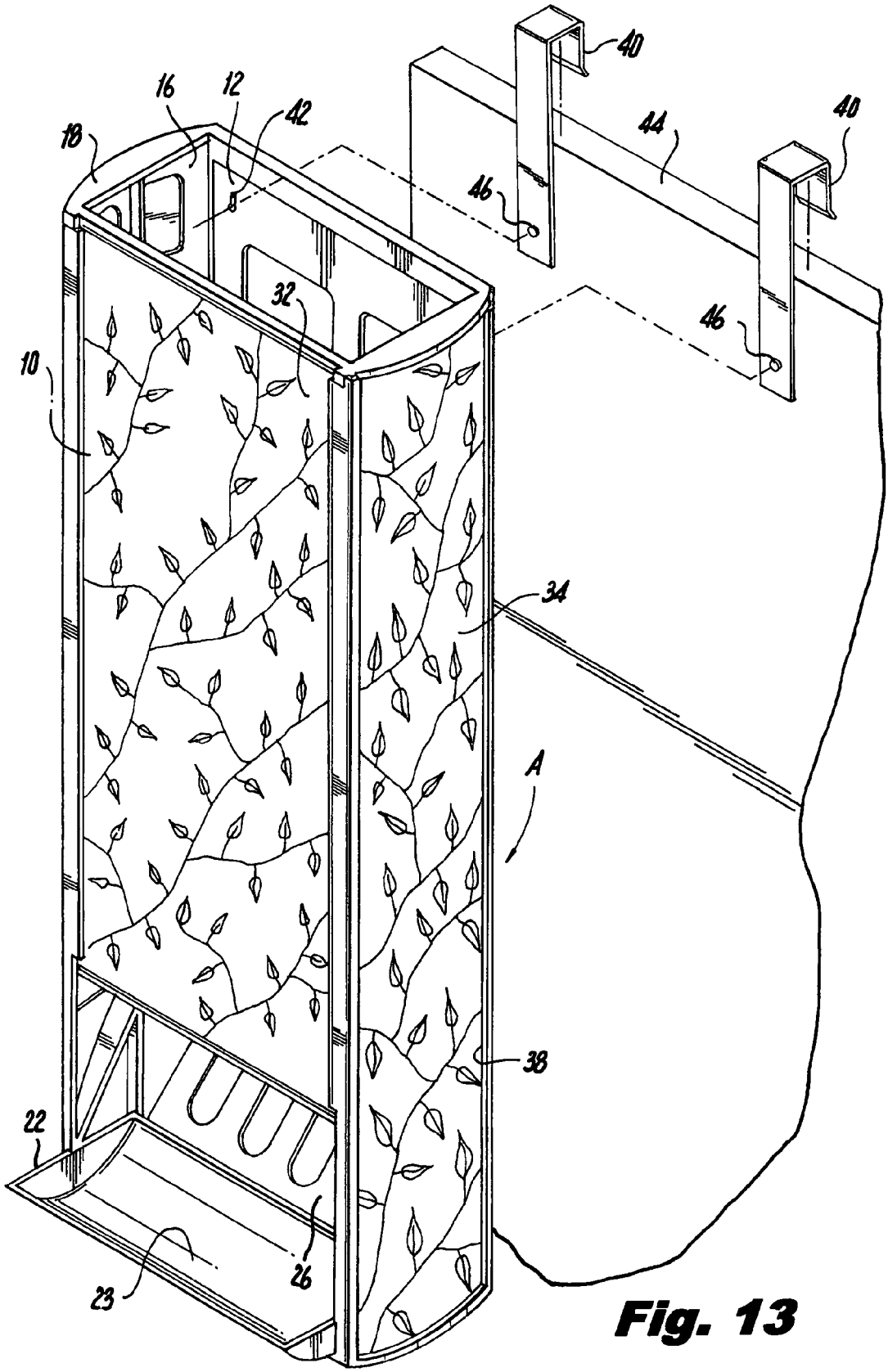
FIG. 13 is an isometric view of the paper dispenser of the present invention showing the top, front wall and one side wall thereof, with the decorative panels in place and the divider removed, showing the door hanging brackets.
Figure 14:
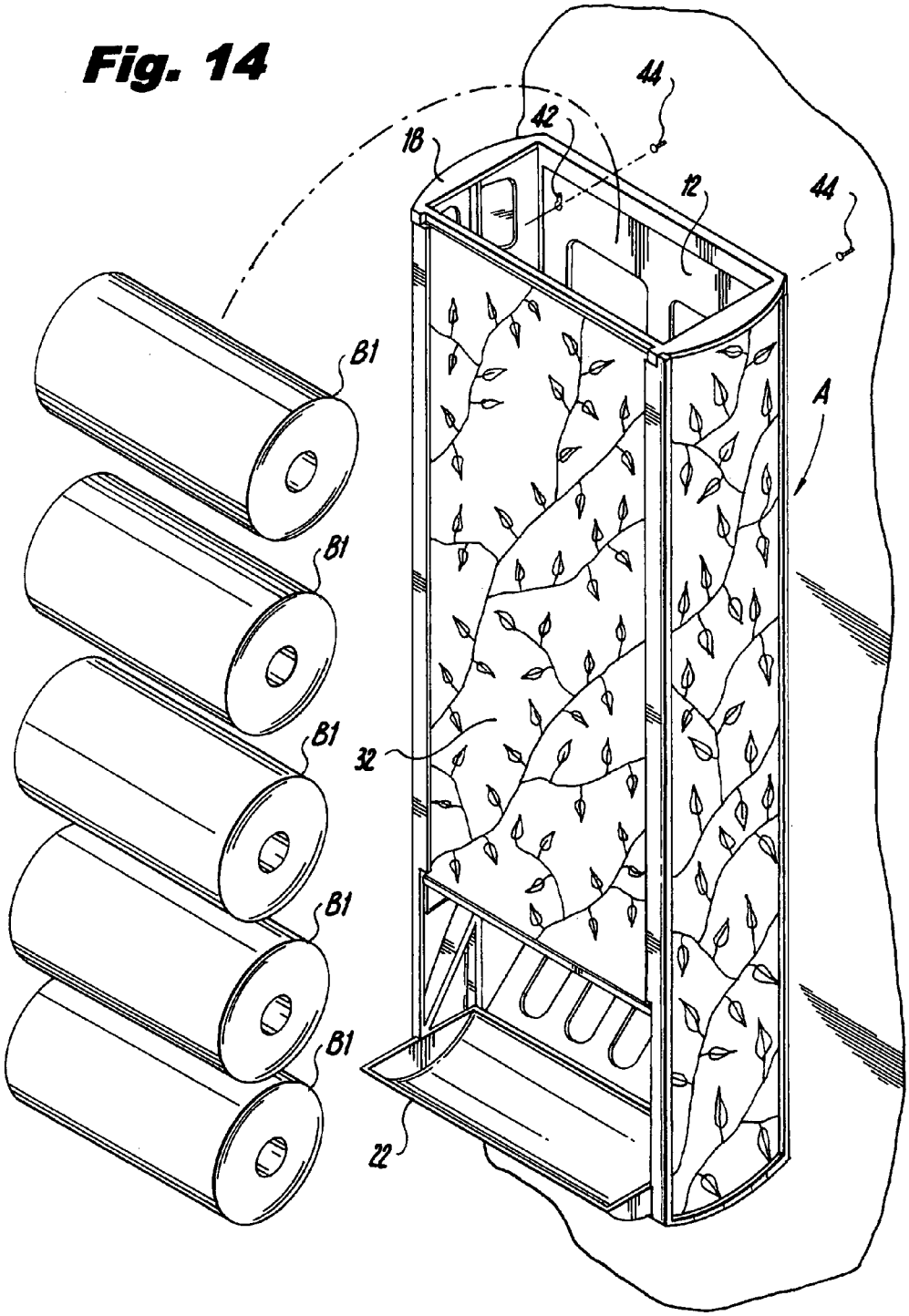
FIG. 14 is a view similar to FIG. 13 showing the paper towel rolls and the wall mounting means.
Figure 15:
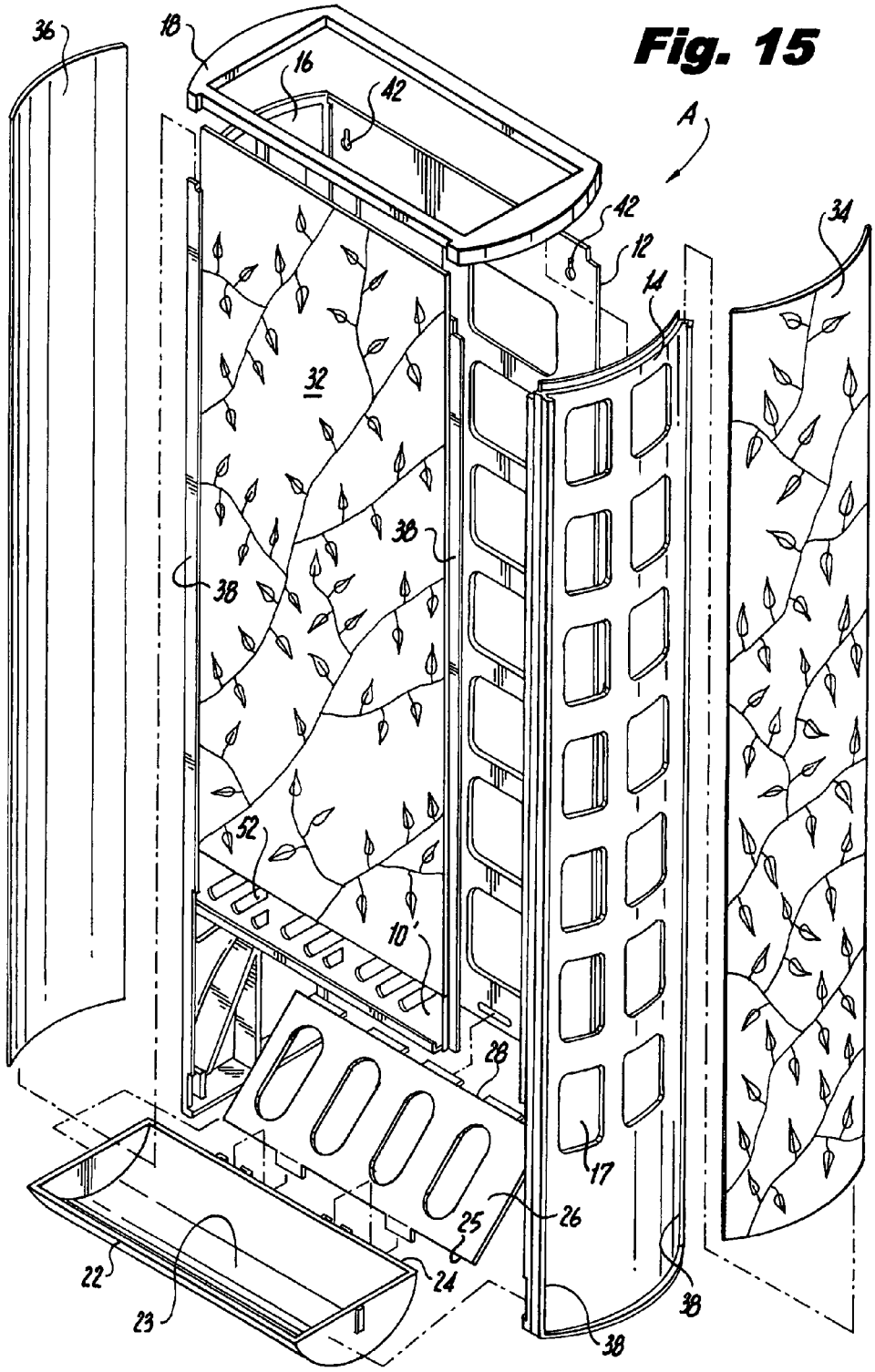
FIG. 15 is an isometric view of the paper dispenser of the present invention showing the top, front wall and one side wall thereof, with the components exploded.

FIGS. 7 and 8 illustrate the structure of removable divider C. Divider C has an inclined bottom 30 adapted to be situated adjacent section 26 of rear wall 12 when the divider is received in the enclosure. The rear surface of divider C has a plurality of spaced, rearwardly extending "T" shaped protrusions 31 adapted to slide into correspondingly shaped recesses in rear wall 12 provided for that purpose. Divider C is situated within the enclosure when it is used with toilet paper rolls B2, as shown in FIGS. 1, 2 and 12, and removed when the dispenser is used with paper towel rolls B1, as shown in FIGS. 13, 14 and 15.

A removable decorative front panel 32 is provided for mounting adjacent front wall 10. Removable decorative side panels 34 and 36 are provided for mounting adjacent side walls 14, 16, respectively. Means are provided for removably mounting the decorative panels. In each case, the panel mounting means includes a pair of oppositely oriented channel defining members 38 extending from the respective edges of the wall to which the panel is mounted, as best seen in see FIGS. 2, 9 and 15. That system permits the decorative panels to be removed by simply sliding the panels upwardly relative to the dispenser when top 18 is removed. Multiple sets of decorative panels may be supplied with the dispenser such that they may be interchanged to alter the appearance of the dispenser, as desired by the user. Further, the user may use home made decorative panels for this purpose.

Preferably, side walls 14, 16 each have an arcuate surface. Accordingly, side panels 34 and 36 may be formed to be arcuate. However, to save shipping space, the side panels are preferably made to be flexible enough to be supplied flat and be flexed to accommodate the arcuate side walls as they are mounted.

The dispenser has an open bottom 40 formed by the bottom edges of the front, and side walls. The dispenser bottom can be supported on any horizontal surface, such as a table top, and thus be free-standing. However, means associated with the rear wall are provided for mounting the enclosure on a vertical surface, such as a wall. Those means preferably take the form of openings 42 in rear wall 12. Conventional screws 44, or any other conventional fastening device of that nature, may be utilized to secure rear wall 12 to the vertical surface. Thus, the dispenser may be supported on a substantially horizontal surface by the bottom or may be mounted on a substantially vertical surface.

The dispenser is also equipped with spaced brackets 40 for mounting the enclosure over the top of a door 44, as illustrated in FIG. 13. Each bracket 42 has an upper portion bent in a "U" so as to form a recess adapted to receive the top of the door. The lower portion of each bracket has a protrusion 46 with an enlarge head to engage one of the openings 42 on the rear wall 12.

Figure 9:
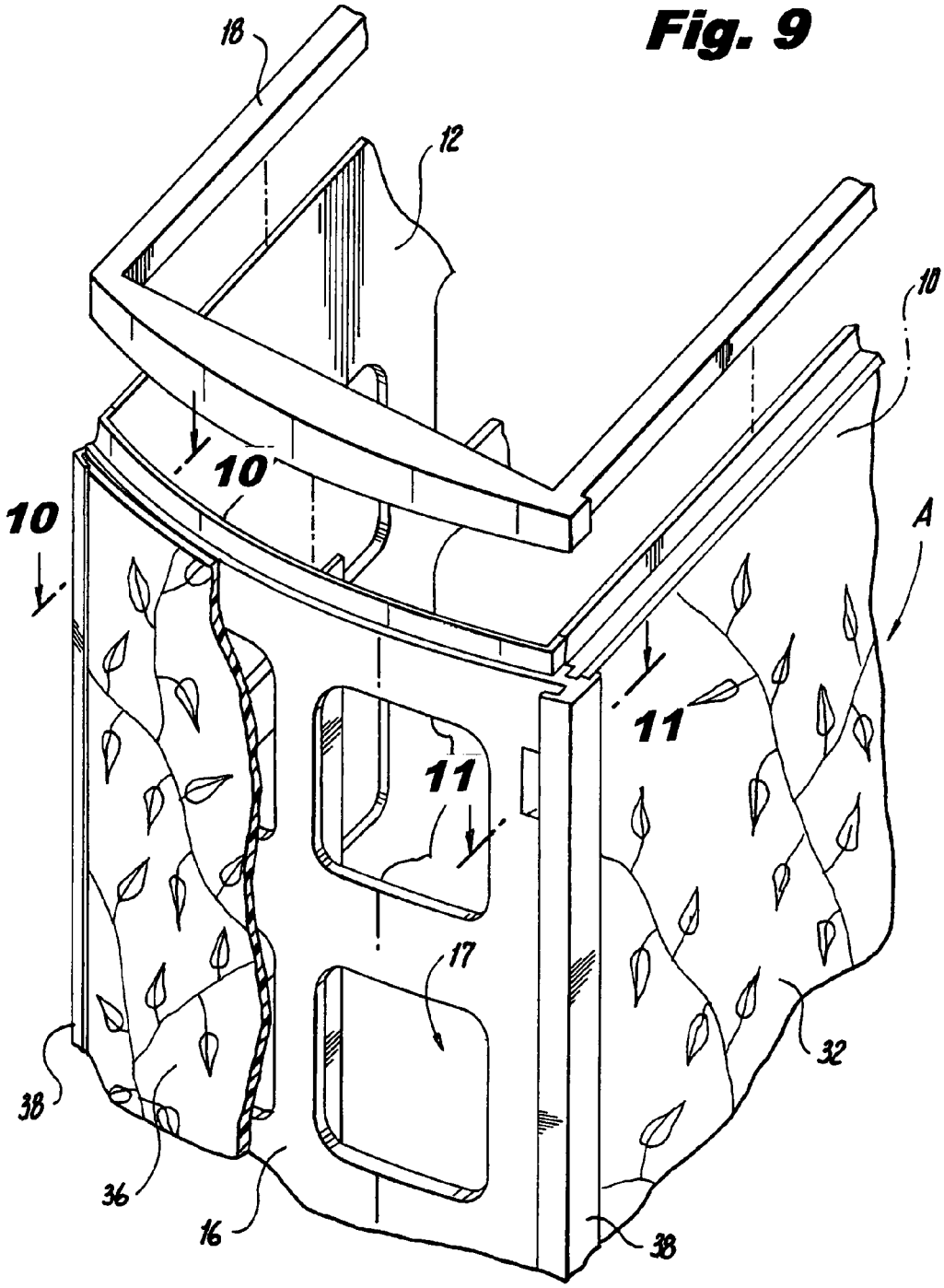
FIG. 9 is an isometric view of the upper portion of the enclosure showing the side decorative panel partially cut away and the top exploded.
Figure 11:
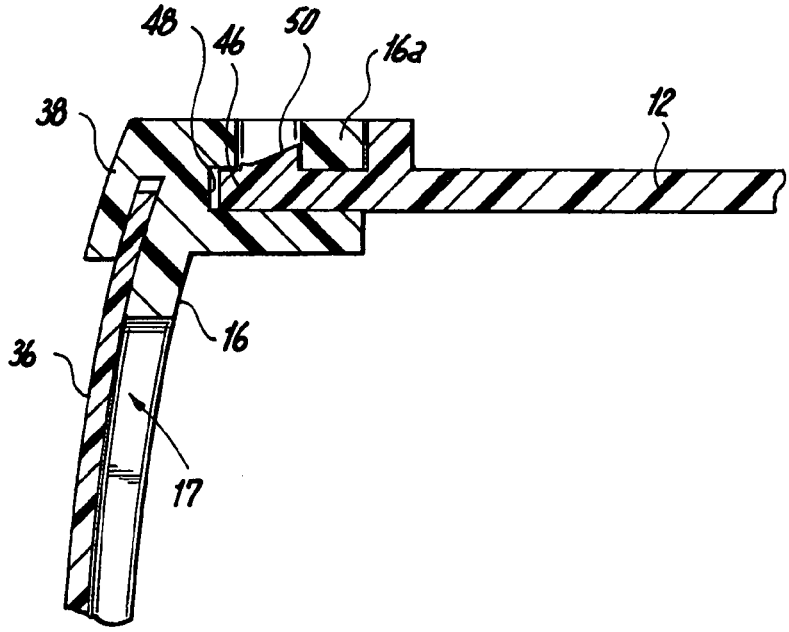
FIG. 11 is a cross-sectional view taken along line 10-11 of FIG. 9.

As best illustrated in FIG. 9, the walls and top of the dispenser are made to snap together such that the dispenser can be assembled easily. FIG. 11 illustrates a typical snap together joint. The edge 46 of rear wall 12 is snap-fit into a channel 48 in side wall 14 by sliding edge 46 toward channel 48 until the inclined saw-tooth shaped edge 50 on the surface of rear wall 12 clears portion 16*a* of the side wall. Once that position is reached, the edge of the rear wall will remain in the channel of the side wall. Once the four walls are attached to each other in that fashion, top 18 is snap-fit over the assembly, in the same fashion. The top also prevents the walls from disengaging.

Figure 10:
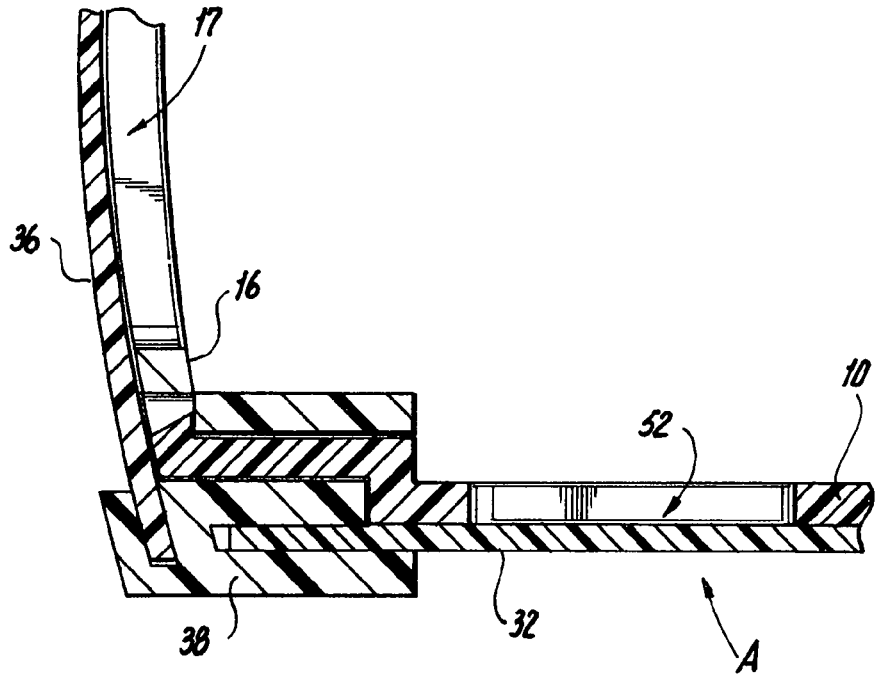
FIG. 10 is a cross-sectional view taken along line 10-10 of FIG. 9.

Another version of the front wall is illustrated in FIGS. 10 and 12. That version of the front wall is referred to as 10'. Wall 10' is identical to the previously described front wall 10, except that openings 17 in the front wall 10 have been replaced by a series of spaced, inclined slots 52. Slots 52 are design to receive photographs 54, as illustrated in FIG. 12, when decorative panel 32 is not present.

Figure 6:
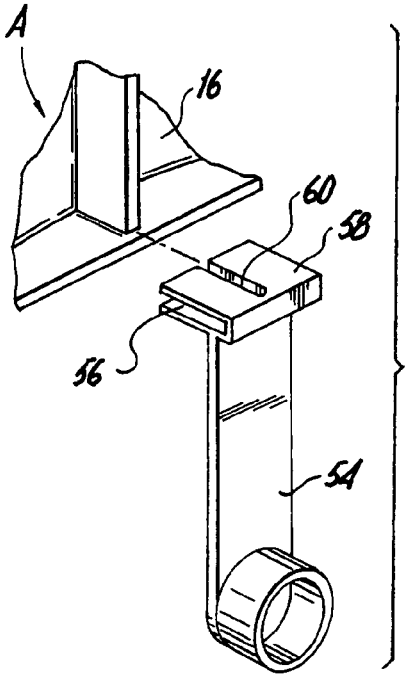
FIG. 6 is an exploded isometric of one of the paper roll mounting brackets.

As seen in FIGS. 1, 6 and 12, a pair of oppositely oriented paper roll mounting brackets 54 are provided to rotatably mount a paper roll to the bottom of the enclosure for dispensing individual paper sheets. As best seen in FIG. 6, each bracket 54 has a clip-like top portion 56 with a bifurcated top member 58 defining a slot 60. Portion 56 of each bracket removably attaches to the bottom of a different one of the side walls 14, 16 as shown in the drawing. In this way, the brackets may be removed, for example, when the dispenser bottom supported on a horizontal surface.

Each bracket has a hollow cylindrical protrusion adapted to be received in the central opening of the roll. Thus the paper roll may rotate relative to the bracket to dispense individual sheets.

It will now be appreciated that the present invention relates to a dispenser for paper rolls. The dispenser includes an enclosure for holding a plurality of paper rolls in stacked, substantially vertical relation. The front wall of the enclosure has an opening through which a paper roll may move to exit the enclosure. A tray is provided for retaining a paper roll as it moves through the exit opening. An inclined section of the rear wall provides a means for guiding the paper roll through the exit opening and into the retaining tray.

A removable divider is provided to convert the dispenser from one that holds and dispenses paper towel rolls to one that holds and dispenses pairs of toilet paper rolls.

Spaced, oppositely oriented brackets extend from the bottom of the dispenser for rotatably mounting paper rolls such that individual paper sheets may be dispensed.

Removable decorative panels are provided for mounting adjacent the front and side walls. Channels are provided for removably mounting the panels.

The enclosure has a bottom. Means associated with the rear wall are provided for mounting the enclosure on a vertical surface, such as a wall. Brackets are provided for hanging the dispenser on a door. Accordingly, the dispenser may be supported on a substantially horizontal surface by the bottom or may be suspended from a substantially vertical surface by the mounting means or from a door by the hanging brackets.

One or more of the walls has an opening for observing the number of papers rolls remaining in the enclosure. In one embodiment, the front wall is provided with slots for removably mounting photographs.

Means are provided for attaching the walls together in snap-fit fashion. The attaching means includes a recess on one of the first and second walls adapted to receive an edge of another wall.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

We claim:

1. A paper roll dispenser comprising an enclosure for holding a plurality of paper rolls in stacked, substantially vertical relation, said enclosure comprising an opening through which a paper roll may move to exit said enclosure and means for retaining a paper roll as the roll passes through said exit opening, further comprising means for converting said enclosure to hold rolls of different sizes.

2. A paper roll dispenser comprising an enclosure for holding a plurality of paper rolls in stacked, substantially vertical relation, said enclosure comprising an opening through which a paper roll may move to exit said enclosure and means for retaining a paper roll as the roll passes through said exit opening, further comprising means for dividing said enclosure into sections.

3. The dispenser of claim 2 wherein said dividing means is removable.

4. A paper roll dispenser comprising an enclosure for holding a plurality of paper rolls in stacked, substantially vertical relation, said enclosure comprising an opening through which a paper roll may move to exit said enclosure and means for retaining a paper roll as the roll passes through said exit opening, wherein said enclosure comprises a wall and further comprising a decorative panel adapted to be mounted proximate said wall.

5. The dispenser of claim 4 further comprising means for guiding a paper roll through said opening and into said retaining means.

6. The dispenser of claim 5 wherein said enclosure comprises a rear wall and wherein said guiding means comprises an inclined section of said rear wall.

7. The dispenser of claim 4 wherein said retaining means comprises a tray having a recess adapted to retain a paper roll.

8. The dispenser of claim 7 wherein said recess is defined at least in part by an arcuate surface.

9. The dispenser of claim 8 wherein said arcuate surface defines a section of a cylinder.

10. The dispenser of claim 4 further comprising means for rotatably mounting a paper roll beneath said enclosure.

11. The dispenser of claim 4 further comprising means for mounting said enclosure on a vertical surface.

12. The dispenser of claim 4 further comprising means for hanging said enclosure on a door.

13. A paper roll dispenser comprising an enclosure for holding a plurality of paper rolls in stacked, substantially vertical relation, said enclosure comprising a wall, a removable decorative panel adapted to be mounted proximate said wall and means for removably mounting said panel.

14. The dispenser of claim 13 wherein said mounting means comprises first and second channels situated proximate the edges of said wall, respectively, so as to define a slot to receive said panel.

15. The dispenser of claim 14 wherein said wall comprises an arcuate surface.

16. The dispenser of claim 13 wherein said wall has a slot adapted to receive a photograph.

17. The dispenser of claim 13 wherein said enclosure comprises a bottom and a rear wall, and means associated with said rear wall for mounting said enclosure, such that said dispenser may be supported on a substantially horizontal surface by said bottom or be suspended from a substantially vertical surface by said mounting means.

18. The dispenser of claim 17 further comprising means for hanging said enclosure from a door.

19. The dispenser of claim 18 wherein said hanging means comprises a bracket defining a recess adapted to receive the top of the door.

20. The dispenser of claim 13 wherein said wall has an opening for observing the number of papers rolls remaining in said enclosure.

21. A paper roll dispenser comprising an enclosure for holding a plurality of paper rolls in stacked, substantially vertical relation, said enclosure comprising first and second adjacent walls, and means for attaching said first and second walls together in a snap-together fashion, said attaching means comprising a recess on one of said first and second walls adapted to receive an edge of the other of said walls.

22. The dispenser of claim 21 wherein said enclosure further comprises a bottom, and means for rotatably mounting a paper roll beneath said enclosure bottom.

23. The dispenser of claim 22 wherein said rotatable mounting means comprises first and second spaced mounting brackets.

* * * * *